US007544067B1

(12) United States Patent
Hatano et al.

(10) Patent No.: US 7,544,067 B1
(45) Date of Patent: Jun. 9, 2009

(54) BOARD MOUNT-TYPE CONNECTOR AND BOARD MOUNT-TYPE CONNECTOR ASSEMBLY

(75) Inventors: Takahiro Hatano, Tokyo (JP); Makiya Kimura, Tokyo (JP); Tomoyuki Takamoto, Gunma (JP); Shin Sakiyama, Saitama (JP); Takashi Sekizuka, Saitama (JP)

(73) Assignees: Tyco Electronics AMP K.K., Kanagawa-Ken (JP); Advantest Corporation, Tokyo (JP)

( * ) Notice: Subject to any disclaimer, the term of this patent is extended or adjusted under 35 U.S.C. 154(b) by 0 days.

(21) Appl. No.: 12/039,796

(22) Filed: Feb. 29, 2008

(51) Int. Cl.
*H01R 12/00* (2006.01)

(52) U.S. Cl. ..... 439/84; 439/74; 439/660

(58) Field of Classification Search ..... 439/65, 439/74, 78, 79, 83, 84, 636, 660, 862
See application file for complete search history.

(56) References Cited

U.S. PATENT DOCUMENTS 4,648,668 A * 3/1987 Sinisi ..... 439/267
5,595,490 A * 1/1997 Cohen et al. ..... 439/74
5,921,787 A * 7/1999 Pope et al. ..... 439/74
6,036,504 A * 3/2000 McHugh et al. ..... 439/74
6,059,580 A * 5/2000 Konno et al. ..... 439/74
6,178,629 B1 * 1/2001 Rathburn ..... 29/843
6,276,942 B1 * 8/2001 Hsiao ..... 439/74
7,241,147 B2 * 7/2007 Lloyd et al. ..... 439/66
7,297,003 B2 * 11/2007 Rathburn et al. ..... 439/66
7,422,439 B2 * 9/2008 Rathburn et al. ..... 439/66
D581,876 S * 12/2008 Hatano et al. ..... D13/147

FOREIGN PATENT DOCUMENTS

JP 03-012383 U 2/1991
JP 11-126667 5/1999

* cited by examiner

*Primary Examiner*—James Harvey
(74) *Attorney, Agent, or Firm*—Barley Snyder LLC

(57) ABSTRACT

A board mount-type connector having an insulative housing with a base and a row of contacts carried by the housing is disclosed. Each contact has a centerpiece secured to the housing along a substantially vertically upright inner wall of the base, a mating interface connected to one end of the centerpiece so that the mating interface contacts a mating contact, and a board interface connected to the remaining end of the centerpiece so that the board interface connects to a circuit board. Each board interface has a bend that initially extends away from an extension line associated with a generally vertically upright portion of the respective centerpiece and that is bent back toward the extension line. A pad interface extends from the free end of the board interface toward the extension line and the contacts of the row are staggered along a length of the row.

20 Claims, 9 Drawing Sheets

Prior Art

Prior Art

BOARD MOUNT-TYPE CONNECTOR AND BOARD MOUNT-TYPE CONNECTOR ASSEMBLY

FIELD OF THE INVENTION

The present invention relates to a board mount-type connector and a board mount-type connector assembly having contacts each of which is provided with a contact part that contacts a mating contact on one side of a base part that is secured to the housing, and an elastic contact part that elastically contacts a conductive pad on a circuit board on the other side of the base part.

BACKGROUND

Electrical connectors having a contact part on one side of a base part that is secured to a housing are known. It is further known that the contact part contacts a mating contact. Still further, such electrical connectors are known to have an elastic contact part that elastically contacts a conductive pad on a circuit board. The elastic contact parts are known to be provided on the other side of the base part, opposite the side with the contact part, in order to make repeated connections with the circuit board for the reason of replacement or the like.

The electrical connector shown in Prior Art FIG. 8 (see JP11-126,667A), for example, is known to be an electrical connector of the type described above. Prior Art FIG. 8 is a cross-sectional view of a conventional electrical connector of the type described above.

The electrical connector 101 shown in Prior Art FIG. 8 comprises an insulating housing 110 and a plurality of contacts 120 made of metal that are attached to the housing 110.

The housing 110 comprises a housing base part 111 that extends in the direction of length (direction perpendicular to the plane of the page in Prior Art FIG. 8) and a ridge part 112 that is provided in the central portion of the housing base part 111 in the direction of width (left-right direction in Prior Art FIG. 8) and that protrudes upward from the housing base part 111 and extends in the direction of length.

Furthermore, the plurality of contacts 120 are arranged in two rows along both left and right side surfaces of the ridge part 112 of the housing 110. Each of the contacts 120 comprises a first plate part 121 and a second plate part 122 that are folded back at one end on the mating side, and is disposed in the housing 110 such that the first plate part 121 is on the outside, and the second plate part 122 is on the inside. The first plate part 121 of each contact 120 is provided with a fastening part 123, a contact part 124, and a connecting part 125. The fastening part is press-fitted in the housing 110. The contact part extends upward from the fastening part 123 and contacts a mating contact of a mating connector (not shown in the figure). The connecting part 125 extends downward from the fastening part 123 and is connected to a circuit board (not shown in the figure). The connecting part 125 comprises a first elastic part 125*a*, a second elastic part 125*b*, and an elastic contact part 125*c*. The first elastic part 125*a* extends in a straight line from the lower end of the fastening part 123 diagonally toward the outside at a small angle off vertical. The second elastic part 125*b* extends in a straight line from the lower end of the first elastic part 125*a* diagonally toward the outside at a large angle off vertical. The elastic contact part 125*c* is provided at the tip end of the second elastic part 125*b* and elastically contacts a conductive pad on the circuit board. Moreover, the elastic contact parts 125*c* of the contacts 120 in each row are arranged so as to form a straight line along the direction of length of the housing 110 (row direction of the contacts 120).

The electrical connector 101 constructed in this manner is secured to the surface of the circuit board by mounting the housing 110 to the circuit board using fixing screws (not shown in the figure) or the like, and the elastic contact parts 125*c* of the respective contacts 120 elastically contact the conductive pads on the circuit board. Furthermore, when the mating connector is caused to mate with the ridge part 112 of the electrical connector 101 while the electrical connector 101 is secured to the surface of the circuit board, the mating contacts make contact with the contact parts of the respective contacts 120, so that the mating contacts and the conductive pads on the circuit board are electrically connected.

Moreover, the electrical connector shown in Prior Art FIG. 9, for example, is known to be an electrical connector in which an elastic contact part that elastically contacts to a circuit board is provided, not on a contact, but on a shield (see JP03-012,383U). Prior Art FIG. 9 is a cross-sectional view of another conventional electrical connector.

The electrical connector 201 shown in Prior Art FIG. 9 comprises an insulating housing 210, a plurality of contacts 220 made of metal that are attached to the housing 210, and a shield 230 made of metal that covers the housing 210.

The plurality of contacts 220 are arranged in two rows along the direction of length of the housing 210 (direction perpendicular to the plane of the page in Prior Art FIG. 9). Each of the contacts 220 comprises an elastic contact part 221 and a terminal part 222. The elastic contact part 221 contacts a first circuit board 250 on the upper side. The terminal part contacts a mating contact 241 provided on a mating connector 240 on the lower side. The mating connector 240 is mounted on a second circuit board 260.

Furthermore, the metal shield 230 covers the housing 210, and a first elastic contact part 231 and a second elastic contact part 232 that elastically contact conductive pads provided on the second circuit board 260 are provided at the lower ends of both sides of the housing 210 in the direction of width (both sides in the left-right direction in Prior Art FIG. 9). The first elastic contact part 231 is designed to extend in a straight line from the lower end of the shield 230 diagonally toward the outside and to elastically contact a conductive pad (not shown in the figure) formed on the second circuit board 260. The second elastic contact part 232 is designed to be bent inward after extending outward from the lower end of the shield 230 and to elastically contact a conductive pad (not shown in the figure) formed on the second circuit board 260 with the tip end of this second elastic contact part 232.

However, the following problems have been encountered in these conventional electrical connectors 101 and 201 shown in Prior Art FIGS. 8 and 9, respectively.

Specifically, in the case of the electrical connector 101 shown in Prior Art FIG. 8, because the connecting parts 125 of the contacts 120 in the two rows extend outward so as to be separated from each other in the direction of width of the housing 110, a large space is required for forming the conductive pads that respectively contact the elastic contact parts 125*c* on the circuit board in the direction of width of the housing 110. Furthermore, because the elastic contact parts 125*c* of the contacts 120 in each row are arranged to form a straight line along the direction of length of the housing 110, a large space is required for forming the conductive pads that respectively contact the elastic contact parts 125*c* in the direction of length of the housing 110 as well. In other words, if an attempt is made to make the conductive pads correspond to the multi-position elastic contact parts 125*c* in a state in which the width of the individual conductive pads contacted by the elastic contact parts 125*c* is large, a large space is required for forming the conductive pads in the direction of length of the housing 110. On the other hand, if an attempt is made to reduce the space required for forming the conductive pads in the direction of length of the housing 110 while corresponding to the multi-position elastic contact parts 125*c*, then the width of each of the conductive pads contacted by the elastic contact parts 125*c* must be reduced.

Here, when the width of each conductive pad is reduced, the elastic contact parts 125*c* tend not to contact the conductive pads. In particular, when numerous electrical connectors 101 are simultaneously connected to a circuit board, there are cases in which the elastic contact parts 125*c* do not contact the conductive pads because of the dimensional tolerance of each contact 120, errors in attachment to the housing 110, the accumulation of the dimensional tolerances of the conductive pads in the direction of length of the housing 110, or the like.

Moreover, in the case of the electrical connector 201 shown in Prior Art FIG. 9, the second elastic contact parts 232 extend outward from the lower end of the shield 230, are then bent inward, and contact conductive pads formed on the second circuit board 260 with the tip ends thereof, therefore, this contributes to a reduction in the space required for forming the conductive pads in the direction of width of the electrical connector 201. However, because the first elastic contact parts 231 still extend in a straight line from the lower end of the shield 230 diagonally toward the outside, and elastically contact conductive pads formed on the second circuit board 260, a large space is required for forming the conductive pads that contact the first elastic contact parts 231 in the direction of width of the housing 210.

SUMMARY

The present invention, in one embodiment among others, relates to a board mount-type connector having an insulative housing with a base and a row of contacts carried by the housing. Each contact has a centerpiece secured to the housing along a substantially vertically upright inner wall of the base, a mating interface connected to one end of the centerpiece so that the mating interface contacts a mating contact, and a board interface connected to the remaining end of the centerpiece so that the board interface connects to a circuit board. Each board interface has a bend that initially extends away from an extension line associated with a generally vertically upright portion of the respective centerpiece and that is bent back toward the extension line. A pad interface extends from the free end of the board interface toward the extension line and the contacts of the row are staggered along a length of the row.

BRIEF DESCRIPTION OF THE DRAWINGS

PRIOR ART

DETAILED DESCRIPTION OF THE EMBODIMENT(S)

Next, an embodiment of the present invention will be described with reference to the figures. A board mount-type connector (hereafter simply referred to as "connector") 1 shown in FIGS. 1 through 5 comprises an insulating housing 10 having first-row contacts 21 and second-row contacts 22 that are secured to the housing 10 in two rows.

Figure 1:
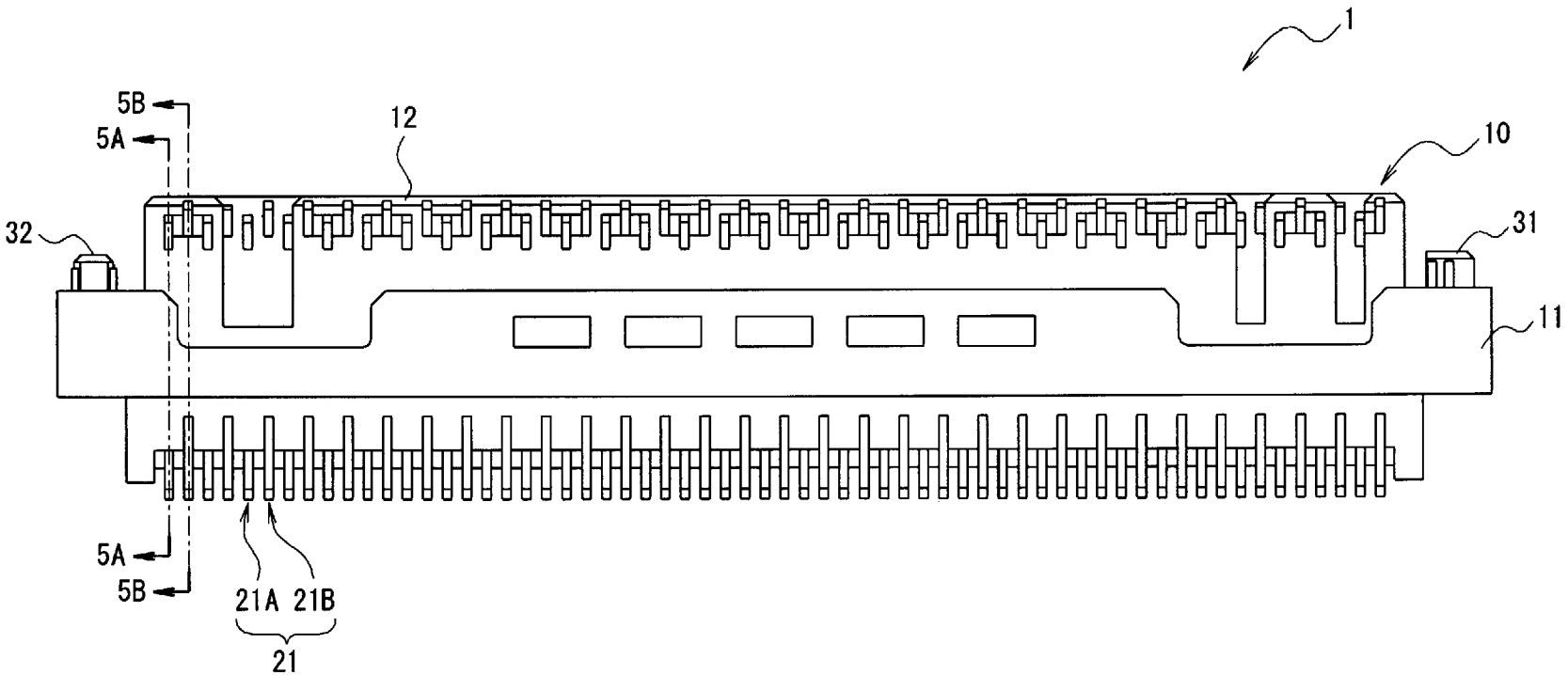
FIG. 1 is a front view of the board mount-type connector of the present invention.
Figure 2:
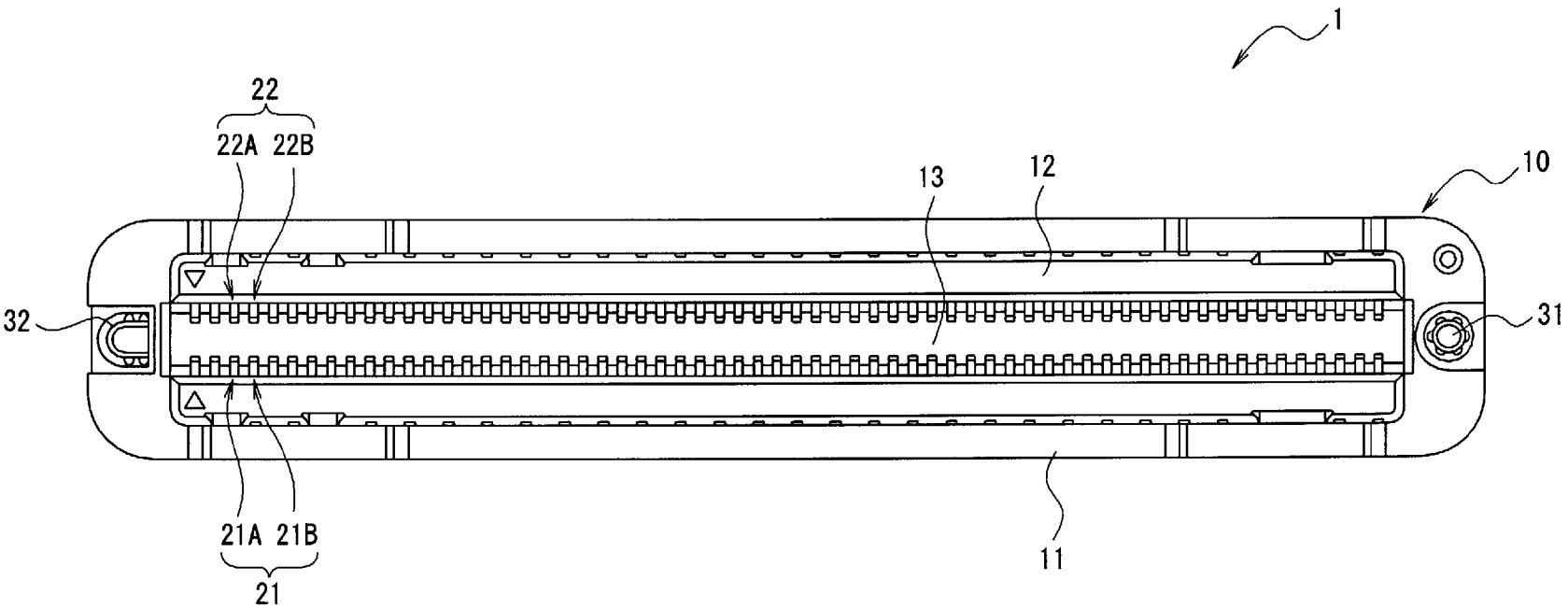
FIG. 2 is a plan view of the board mount-type connector of FIG. 1.
Figure 3:
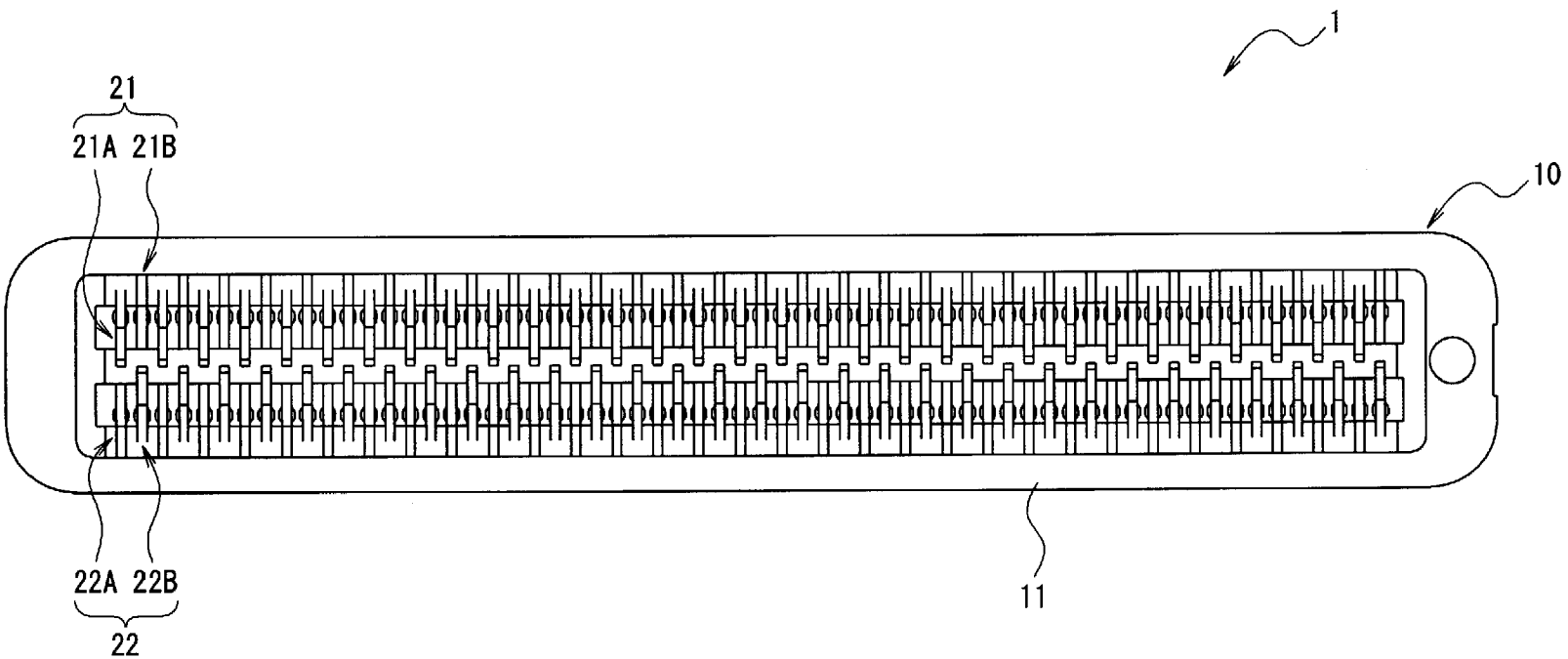
FIG. 3 is a bottom view of the board mount-type connector of FIG. 1.
Figure 4:
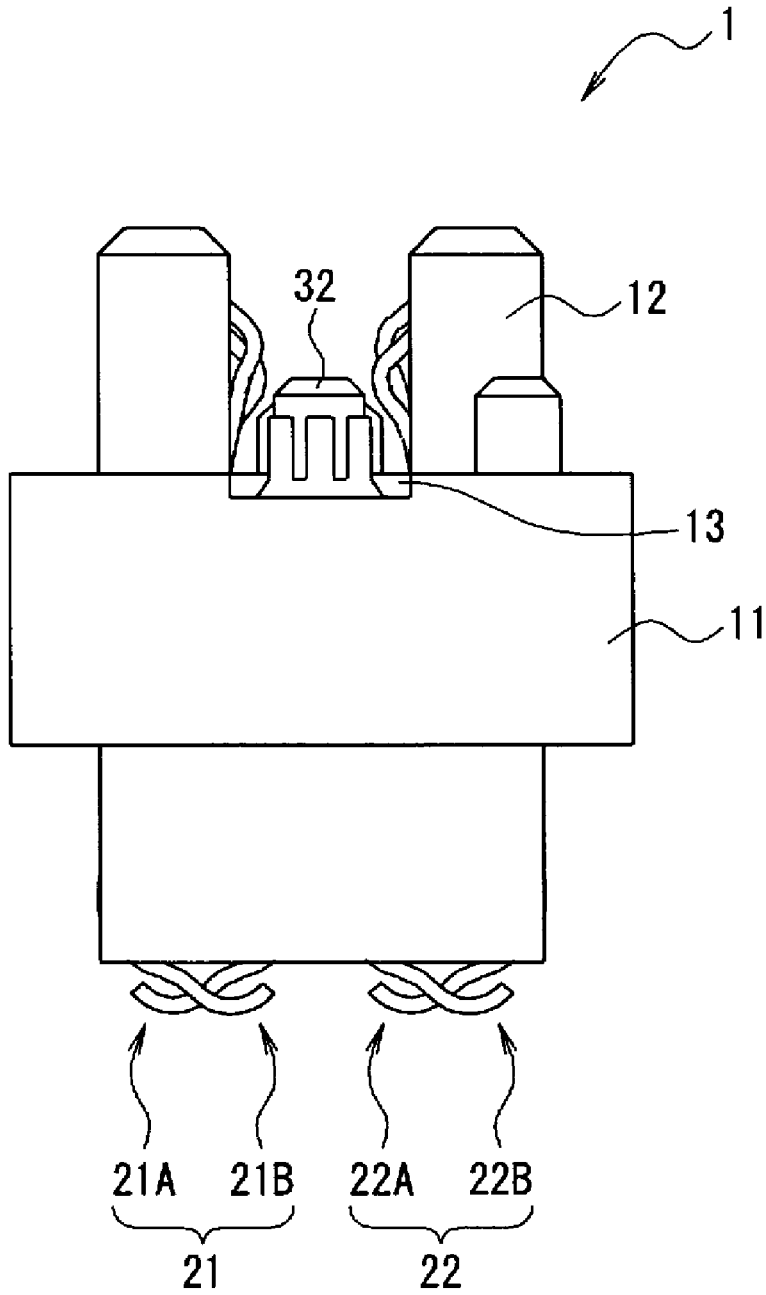
FIG. 4 is a left side view of the board mount-type connector of FIG. 1.
Figure 5B:
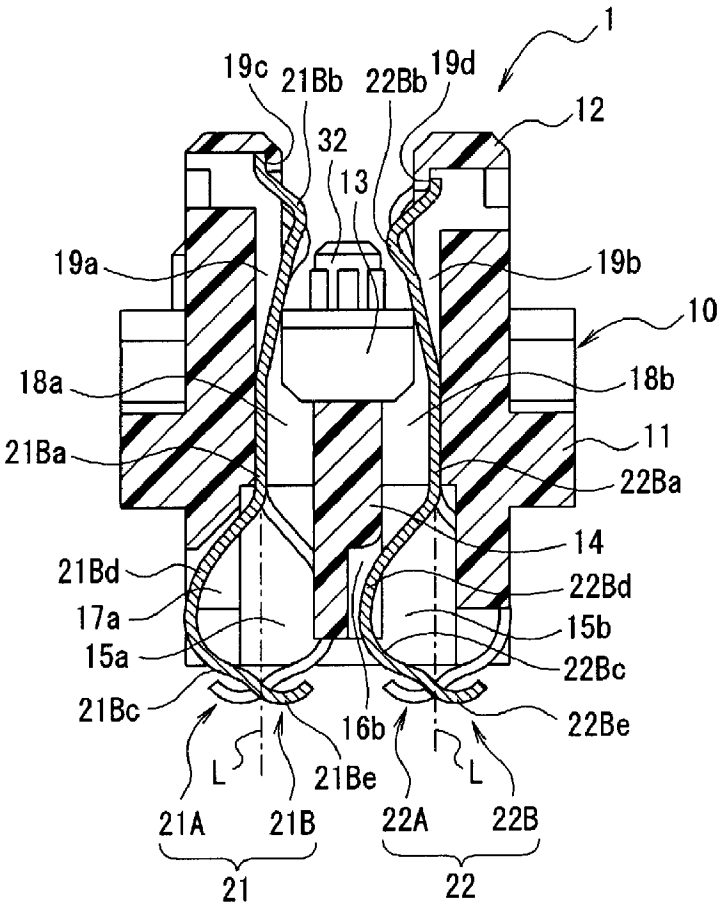
FIG. 5B is a cross-sectional view along line 5B-5B in FIG. 1 of the board mount-type connector of FIG. 1.
Figure 5A:
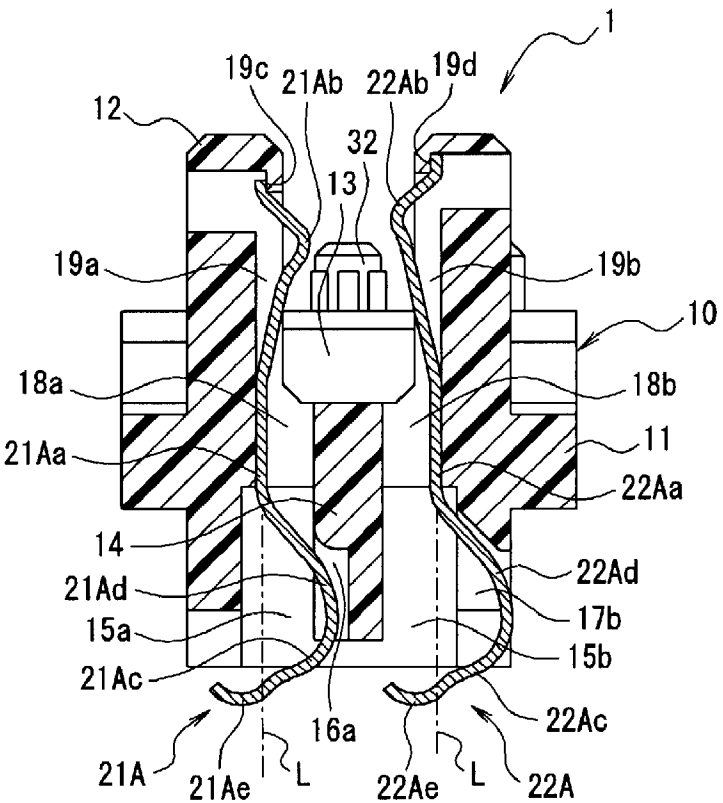
FIG. 5A is a cross-sectional view along line 5A-5A in FIG. 1 of the board mount-type connector of FIG. 1.

Here, as is shown in FIGS. 1 through 4, the housing 10 comprises a base 11 that extends in the direction of length (left-right direction in FIG. 1) and a mating wall 12 that extends along the direction of length of the base 11 and that protrudes upward (upward in FIG. 1) from the base 11. The housing 10 is formed by molding an insulative resin. A mating recess 13 that extends along the direction of length of the mating wall 12 and that receives a mating part of a mating connector (not shown in the figures) is formed in the mating wall 12 of the housing 10. Furthermore, as is shown in FIGS. 5A and 5B, in the lower portion of the base 11, a first contact recess 15*a* is formed in the front side (left side in FIG. 5A) of a partition wall 14 that extends in the direction of length, and a second contact recess 15*b* is formed in the rear side of the partition wall 14. The first contact recess 15*a* and second contact recess 15*b* both extend along the direction of length of the base 11. Moreover, a plurality of first-row contact securing holes 18*a* that pass through toward the first contact recess 15*a* and a plurality of second-row contact securing holes 18*b* that pass through toward the second contact recess 15*b* are formed in the bottom portion of the mating recess 13. The first-row contact securing holes 18*a* and second-row contact securing holes 18*b* are respectively formed at a specified pitch along the direction of length of the base 11. The first-row contact securing holes 18*a* and second-row contact securing holes 18*b* are formed in mutually facing positions in the direction of length of the base 11. In addition, a plurality of first-row contact receiving grooves 19*a* that respectively extend upward from the first-row contact securing holes 18*a* are formed to the front side of the mating recess 13. Further, a plurality of second-row contact receiving grooves 19*b* that respectively extend upward from the second-row contact securing holes 18*b* are formed to the rear side of the mating recess 13. Still further, first and second press-fitting posts 31 and 32 used with respect to a frame 40 (see FIG. 6) are provided on both ends of the housing 10 in the direction of length.

Next, the first-row contacts 21 comprise first contacts 21A and second contacts 21B that are secured alternately at a specified pitch along the front side of the mating recess 13. As is clearly shown in FIG. 5A, each of the first contacts 21A comprises a first centerpiece 21Aa, a first mating interface 21Ab, and a first board interface 21Ac. The first centerpiece 21Aa is secured to an individual first-row contact securing hole 18*a*. The first mating interface 21Ab is provided on the upper side of the first centerpiece 21Aa and contacts a mating contact (not shown in the figures). The first board interface 21Ac is provided on the lower side of the first centerpiece 21Aa and is to be connected to a circuit board PCB (see FIG. 6). Each first contact 21A is formed by stamping and forming a conductive sheet metal having elasticity. The first mating interface 21Ab extends upward from the upper end of the first centerpiece 21Aa so as to protrude into the mating recess 13, and the tip end of the first mating interface 21Ab engages with a projection provided on the mating wall 12 of the housing 10, so that a preload is applied. The first mating interface 21Ab is located in a position corresponding to a first-row contact receiving groove 19*a*, and can therefore be displaced inside the first-row contact receiving groove 19*a*. Furthermore, as is shown in FIG. 5A, the first board interface 21Ac comprises a first bend 21Ad that is bent inward (forward) after extending outward (rearward) from the lower end of the first centerpiece 21Aa, and a first pad interface 21Ae that extends from the tip end of the first bend 21Ad toward the extension line L of the first centerpiece 21Aa. The extension line L of the first centerpiece 21Aa extends substantially vertically down from the inner wall of base 11 against which inner wall the first centerpiece 21Aa is generally at least partially abutted against. The first bend 21Ad is formed with a thickness that is constant and smaller than the thickness of the first centerpiece 21Aa. The first pad interface 21Ae elastically contacts a conductive pad PA (see FIG. 7) formed on the circuit board PCB. The first pad interface 21Ae extends toward the opposite side of the first bend 21Ad (forward) beyond the extension line L of the first centerpiece 21Aa. Furthermore, first bend grooves 16*a* for allowing the first bent parts 21Ad to be respectively positioned and displaced are formed in the front surface of the partition wall 14 of the housing 10.

Moreover, as is clearly shown in FIG. 5B, as in the case with the first contacts 21A, each of the second contacts 21B comprises a second centerpiece 21Ba that is secured to an individual first-row contact securing hole 18*a*, a second mating interface 21Bb that is provided on the upper side of the second centerpiece 21Ba and that contacts a mating contact (not shown in the figures), and a second board interface 21Bc that is provided on the lower side of the second centerpiece 21Ba and that is to be connected to the circuit board PCB. Each second contact 21B is formed by stamping and forming a conductive sheet metal having elasticity. The second mating interface 21Bb extends upward from the upper end of the second centerpiece 21Ba so as to protrude into the mating recess 13, and the tip end of the second mating interface 21Bb engages with a projection provided on the mating wall 12 of the housing 10, so that a preload is applied. The second mating interface 21Bb is located in a position corresponding to a first-row contact receiving groove 19*a*, and can therefore be displaced inside the first-row contact receiving groove 19*a*. Furthermore, the position of the second mating interface 21Bb that contacts a mating contact is shifted in the vertical direction from the position of the first mating interface 21Ab that contacts a mating contact. In addition, as is shown in FIG. 5B, the second board interface 21Bc comprises a second bend 21Bd that is bent inward (rearward) after extending outward (forward) from the lower end of the second centerpiece 21Ba, and an elastic second pad interface 21Be that extends from the tip end of the second bend 21Bd toward the extension line L of the second centerpiece 21Ba. The extension line L of the second centerpiece 21Ba extends substantially vertically down from the inner wall of base 11 against which inner wall the second centerpiece 21Ba is generally at least partially abutted against. The second bend 21Bd is formed with a thickness that is constant and smaller than the thickness of the second centerpiece 21Ba. The second pad interface 21Be elastically contacts a conductive pad PB formed on the circuit board PCB. The second pad interface 21Be extends toward the opposite side of the second bend 21Bd (rearward) beyond the extension line L of the second centerpiece 21Ba. Furthermore, first cutouts 17*a* for allowing the second bends 21Bd to be respectively positioned and displaced are formed in the front wall of the first recessed part 15*a* of the housing 10.

Here, the first bends 21Ad of the first contacts 21A respectively extend rearward from the lower ends of the first centerpieces 21Aa, and are then bent forward, while the second bends 21Bd of the second contacts 21B respectively extend forward from the lower ends of the second centerpieces 21Ba, and are then bent rearward. As a result, the first and second bends 21Ad and 21Bd are arranged in a staggered fashion along the row direction of the first-row contacts 21. Moreover, the first pad interfaces 21Ae respectively extend toward the opposite side of the first bends 21Ad (forward) beyond the extension line L of the first centerpieces 21Aa, while the second pad interfaces 21Be respectively extend toward the opposite side of the second bends 21Bd (rearward) beyond the extension line L of the second centerpieces 21Ba. As a result, the first and second pad interfaces 21Ae and 21Be are arranged in a staggered fashion along the row direction of the first-row contacts 21. Furthermore, as long as these first and second pad interfaces 21Ae and 21Be are arranged in a staggered fashion along the row direction of the first-row contacts 21, it is not necessarily needed that the first pad interfaces 21Ae respectively extend toward the opposite side of the first bends 21Ad beyond the extension line L of the first centerpieces 21Aa, nor that the second pad interfaces 21Be respectively extend toward the opposite side of the second bends 21Bd beyond the extension line L of the second centerpieces 21Ba.

In addition, the second-row contacts 22 have third contacts 22A and fourth contacts 22B that are secured alternately at a specified pitch along the rear wall of the mating recess 13. As is clearly shown in FIG. 5A, the third contacts 22A are disposed respectively facing the first contacts 21A in the front-back direction of the connector 1. Similar to the first contact 21A, each of the third contacts 22A comprises a third centerpiece 22Aa that is secured to an individual second-row contact securing hole 18*b*, a third mating interface 22Ab that is provided on the upper side of the third centerpiece 22Aa and that contacts a mating contact (not shown in the figures), and a third board interface 22Ac that is provided on the lower side of the third centerpiece 22Aa and that is to be connected to the circuit board PCB. Each third contact 22A is formed by stamping and forming a conductive sheet metal having elasticity. The third mating interface 22Ab extends upward from the upper end of the third centerpiece 22Aa so as to protrude into the mating recess 13, and the tip end of the third mating interface 22Ab engages with a projection provided on the mating wall 12 of the housing 10, so that a preload is applied. The third mating interface 22Ab is located in a position corresponding to a second-row contact receiving groove 19*b*, and can therefore be displaced inside the second-row contact receiving groove 19*b*. Furthermore, the position of the third mating interface 22Ab that contacts a mating contact is shifted in the vertical direction from the position of the first mating interface 21Ab that contacts a mating contact. Moreover, as is shown in FIG. 5A, the third board interface 22Ac comprises a third bend 22Ad that is bent inward (forward) after extending outward (rearward) from the lower end of the third centerpiece 22Aa, and an third pad interface 22Ae that extends from the tip end of the third bend 22Ad toward the extension line L of the third centerpiece 22Aa. The extension line L of the third centerpiece 22Aa extends substantially vertically down from the inner wall of base 11 against which inner wall the first centerpiece 22Aa is generally at least partially abutted against. The third bend 22Ad is formed with a thickness that is constant and smaller than the thickness of the third centerpiece 22Aa. The third pad interface 22Ae elastically contacts a conductive pad PA formed on the circuit board PCB. The third pad interface 22Ae extends toward the opposite side of the third bend 22Ad (forward) beyond the extension line L of the third centerpiece 22Aa. Furthermore, second cutouts 17*b* for allowing the third bends 22Ad to be respectively positioned and displaced are formed in the rear wall of the second recessed part 15*b* of the housing 10.

Moreover, as is shown in FIG. 5B, the fourth contacts 22B are disposed respectively facing the second contacts 21B in the front-back direction of the connector 1. As is clearly shown in FIG. 5B, similar to the case with the third contacts 22A, each of the fourth contacts 22B comprises a fourth centerpiece 22Ba that is secured to an individual second-row contact securing hole 18*b*, a fourth mating interface 22Bb that is provided on the upper side of the fourth centerpiece 22Ba and that contacts a mating contact (not shown in the figures), and a fourth board interface 22Bc that is provided on the lower side of the fourth centerpiece 22Ba and that is to be connected to the circuit board PCB. Each fourth contact 22B is formed by stamping and forming a conductive sheet metal having elasticity. The fourth mating interface 22Bb extends upward from the upper end of the fourth centerpiece 22Ba so as to protrude into the mating recess 13, and the tip end of the fourth mating interface 22Bb engages with a projection provided on the mating wall 12 of the housing 10, so that a preload is applied. The fourth mating interface 22Bb is located in a position corresponding to a second-row contact receiving groove 19*b*, and can therefore be displaced inside the second-row contact receiving groove 19*b*. Furthermore, the position of the fourth mating interface 22Bb that contacts a mating contact is shifted in the vertical direction from the position of the third mating interface 22Ab of the third contact 22A that contacts a mating contact. In addition, as is shown in FIG. 5B, the fourth board interface 22Bc comprises a fourth bend 22Bd that is bent inward (rearward) after extending outward (forward) from the lower end of the fourth centerpiece 22Ba, and an elastic fourth pad interface 22Be that extends from the tip end of the fourth bend 22Bd toward the extension line L of the fourth centerpiece 22Ba. The extension line L of the fourth centerpiece 22Ba extends substantially vertically down from the inner wall of base 11 against which inner wall the first centerpiece 22Ba is generally at least partially abutted against. The fourth bend 22Bd is formed with a thickness that is constant and smaller than the thickness of the fourth centerpiece 22Ba. The fourth pad interface 22Be elastically contacts a conductive pad PB formed on the circuit board PCB. The fourth pad interface 22Be extends toward the opposite side of the fourth bend 22Bd (rearward) beyond the extension line L of the fourth centerpiece 22Ba. Furthermore, second bend grooves 16*b* for allowing the fourth bends 22Bd to be respectively positioned and displaced are formed in the rear surface of the partition wall 14 of the housing 10.

Here, the third bends 22Ad of the third contacts 22A respectively extend rearward from the lower ends of the third centerpieces 22Aa, and are then bent forward, while the fourth bends 22Bd of the fourth contacts 22B respectively extend forward from the lower ends of the fourth centerpieces 22Ba, and are then bent rearward. As a result, the third and fourth bends 22Ad and 22Bd are arranged in a staggered fashion along the row direction of the second-row contacts 22. Moreover, the third pad interfaces 22Ae respectively extend toward the opposite side of the third bends 22Ad (forward) beyond the extension line L of the third centerpieces 22Aa, while the fourth pad interfaces 22Be respectively extend toward the opposite side of the fourth bends 22Bd (rearward) beyond the extension line L of the fourth centerpieces 22Ba. As a result, the third and fourth pad interfaces 22Ae and 22Be are arranged in a staggered fashion along the row direction of the second-row contacts 22. Furthermore, as long as these third and fourth pad interfaces 22Ae and 22Be are arranged in a staggered fashion along the row direction of the second-row contacts 22, it is not necessarily needed that the third pad interfaces 22Ae respectively extend toward the opposite side of the third bends 22Ad beyond the extension line L of the third centerpieces 22Aa, nor that the fourth pad interfaces 22Be respectively extend toward the opposite side of the fourth bends 22Bd beyond the extension line L of the fourth centerpieces 22Ba.

Figure 7:
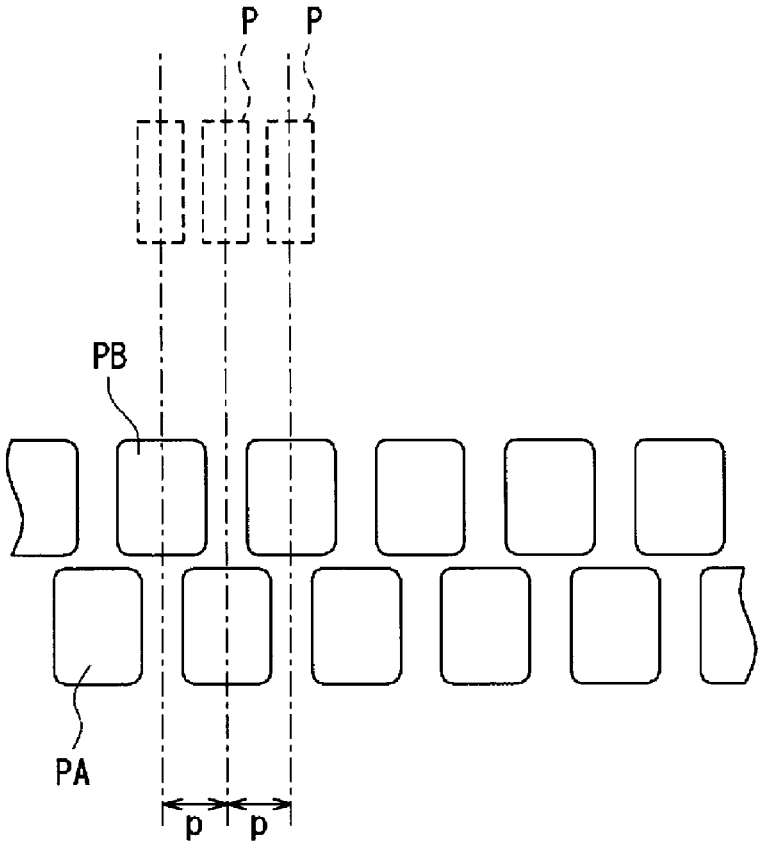
FIG. 7 is a schematic plan view of conductive pads formed on the circuit board.
Figure 8:
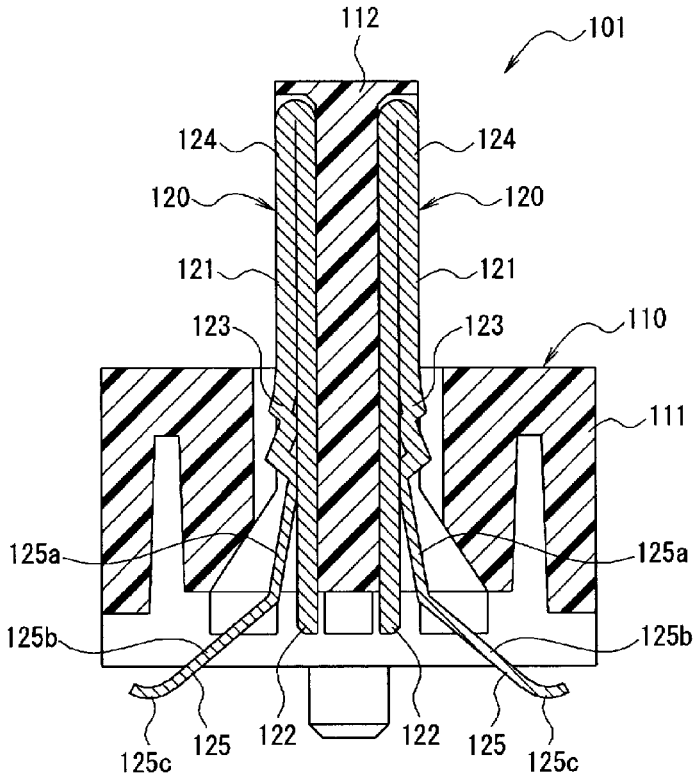
FIG. 8 is a sectional view of a conventional example of an electrical connector; and PRIOR ART
Figure 9:
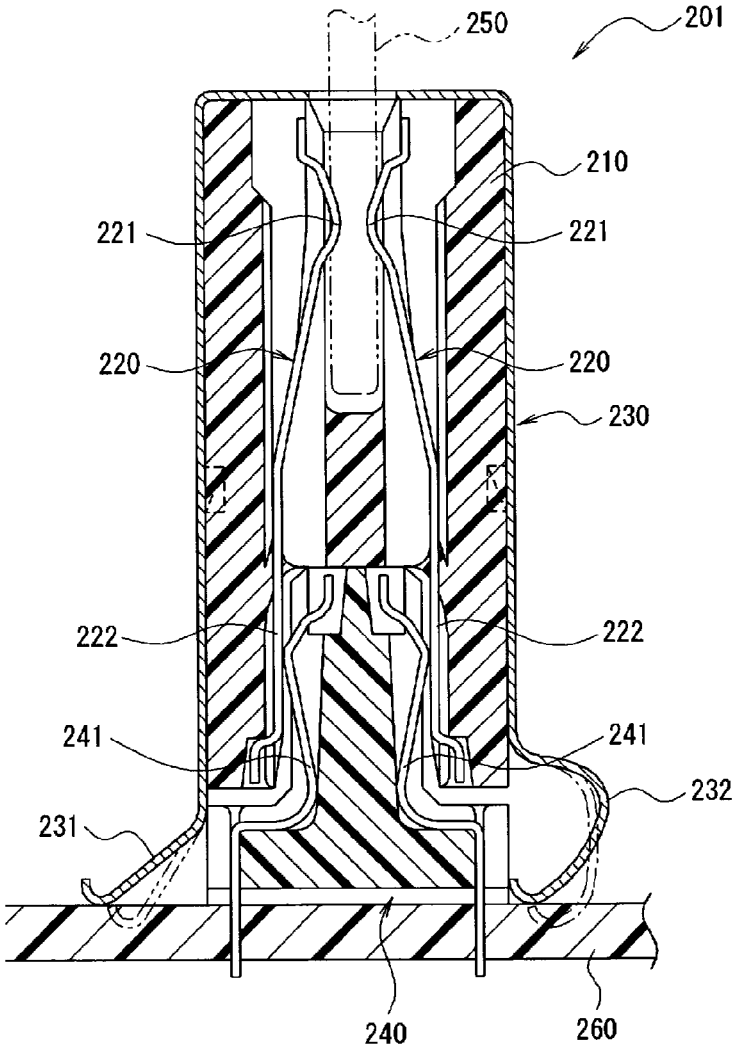
FIG. 9 is a sectional view of another conventional example of an electrical connector.

Next, the conductive pads formed on the circuit board will be described with reference to FIG. 7. FIG. 7 is a schematic plan view of conductive pads formed on the circuit board.

The conductive pads PA and PB formed on the circuit board PCB are formed in two rows corresponding to the first-row contacts 21 and second-row contacts 22 (only the conductive pads PA and PB in the first row are shown in FIG. 7). Furthermore, the conductive pads PA and PB in the first row are arranged in a staggered fashion at a pitch p along the row direction so as to be contacted by the first and second pad interfaces 21Ae and 21Be of the first-row contacts 21, and the conductive pads PA and PB in the second row are also arranged in a staggered fashion at the pitch p along the row direction so as to be contacted by the third and fourth pad interfaces 22Ae and 22Be of the second-row contacts 22.

Here, the first, second, third, and fourth pad interfaces 21Ae, 21Be, 22Ae, and 22Be which respectively extend toward the extension lines L of the first, second, third, and fourth centerpieces 21Aa, 21Ba, 22Aa, and 22Ba of the first-row contacts 21 and second-row contacts 22 from the tip ends of the first, second, third, and fourth bends 21Ad, 21Bd, 22Ad, and 22Bd that are bent inward after extending outward from the first, second, third, and fourth centerpieces 21Aa, 21Ba, 22Aa, and 22Ba contact the conductive pads PA and PB in the respective rows. Therefore, there is no increase in the space required for forming the conductive pads PA and PB on the circuit board PCB in the inward-outward direction (front-back direction) of the connector 1.

Furthermore, the first, second, third, and fourth pad interfaces 21Ae, 21Be, 22Ae, and 22Be of the first-row contacts 21 and second-row contacts 22 are respectively arranged in a staggered fashion along the row direction of the contacts 21 and 22, and the conductive pads PA and PB in each row are arranged in a staggered fashion along the row direction corresponding to these elastic contact parts. Accordingly, even though the respective conductive pads PA and PB correspond to the multi-position first, second, third, and fourth pad interfaces 21Ae, 21Be, 22Ae, and 22Be in a state in which the width of the respective conductive pads PA and PB contacted by the first, second, third, and fourth pad interfaces 21Ae, 21Be, 22Ae, and 22Be is large, there is no increase in the space required for forming the conductive pads PA and PB in the row direction of the first-row contacts 21 and second-row contacts 22. Consequently, it is possible to increase the width of each of the conductive pads PA and PB without requiring a large space required for forming on the circuit board PCB the conductive pads PA and PB with which the first, second, third, and fourth pad interfaces 21Ae, 21Be, 22Ae, and 22Be make contact, thus making it possible for the first, second, third, and fourth pad interfaces 21Ae, 21Be, 22Ae, and 22Be to respectively contact the conductive pads PA and PB in a reliable manner even when numerous connectors 1 are simultaneously connected to the circuit board PCB.

Specifically, if an attempt is made to reduce the space required for forming the conductive pads P in the row direction while corresponding to the multipole elastic contact parts in cases where the conductive pads P are formed in a straight line along the row direction as indicated by the broken line in FIG. 7, the width of each of the conductive pads P must be reduced. If the width of each of the conductive pads P is reduced, when numerous connectors are simultaneously connected to a circuit board, in particular, there are cases in which the elastic contact parts do not contact the conductive pads P because of the dimensional tolerance of each contact, errors in attachment to the housing, the accumulation of the dimensional tolerances of the conductive pads P in the row direction of the conductive pads P, or the like. This problem can be avoided by respectively arranging the first, second, third, and fourth pad interfaces 21Ae, 21Be, 22Ae, and 22Be of the first-row contacts 21 and second-row contacts 22 in a staggered fashion along the row direction of the first-row contacts 21 and second-row contacts 22, and arranging the conductive pads PA and PB in each row in a staggered fashion along the row direction corresponding to these elastic contact parts.

Figure 6:
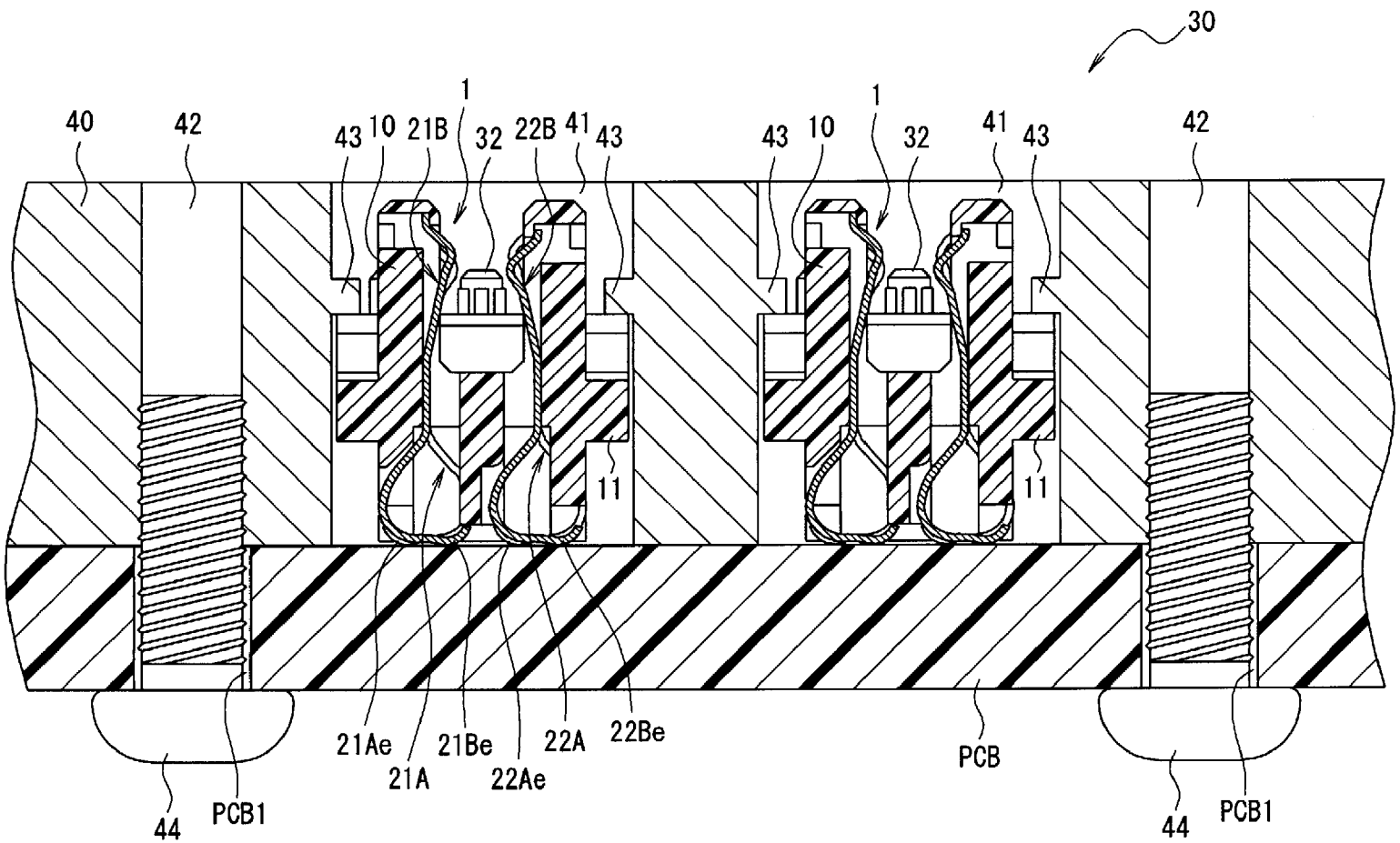
FIG. 6 is a cross-sectional view in a state in which a board mount-type connector assembly is connected to a circuit board.

Moreover, a large number of connectors 1 are prepared in order to connect the numerous connectors 1 simultaneously to a circuit board PCB, and each connector 1 is accommodated and secured inside a connector accommodating hole 41 in the frame 40 as shown in FIG. 6. The respective connectors 1 are secured inside the connector accommodating holes 41 in the frame 40 by press-fitting into the frame 40 the first and second press-fitting posts 31 and 32 provided on both ends of the housing 10 in the direction of length. As a result, a board mount-type connector assembly (connector assembly) 30 is completed. Furthermore, stoppers 43 are formed so as to protrude inward from each connector accommodating hole 41 in the frame 40. When each of the connectors 1 is press-fitted in the frame 40, the base 11 contacts the stoppers 43, so that the movement of the base 11 is restricted.

Then, as is shown in FIG. 6, the first, second, third, and fourth pad interfaces 21Ae, 21Be, 22Ae, and 22Be of the connectors 1 are respectively caused to elastically contact the conductive pads PA and PB formed on the circuit board PCB, and fixing screws 44 are passed through through-holes PCB 1 formed in the circuit board PCB, and are engaged with screw holes 42 in the frame 40. As a result, the connection of the connectors 1 to the circuit board PCB is completed.

When the mating part of a mating connector is caused to mate with the mating recess 13 of each connector 1 in this state, the mating contacts make contact with the first and second mating interfaces 21Ab and 21Bb of the first-row contacts 21 and the third and fourth mating interfaces 22Ab and 22Bb of the second-row contacts 22, so that the mating contacts and the conductive pads PA and PB on the circuit board PCB are electrically connected.

Furthermore, when the circuit board PCB is to be replaced, it is only necessary to remove the fixing screws 44 from the screw holes 42 in the frame 40, to respectively cause the first, second, third, and fourth pad interfaces 21Ae, 21Be, 22Ae, and 22Be of the connectors 1 to elastically contact the conductive pads PA and PB formed on a new circuit board PCB, to pass the fixing screws 44 through the through-holes PCB 1 formed in the circuit board PCB, and to engage these fixing screws 44 with the screw holes 42 in the frame 40.

Here, the first, second, third, and fourth pad interfaces 21Ae, 21Be, 22Ae, and 22Be of the first-row contacts 21 and second-row contacts 22 respectively extend from the tip ends of the first, second, third, and fourth bends 21Ad, 21Bd, 22Ad, and 22Bd that are bent inward after extending outward from the first, second, third, and fourth centerpieces 21Aa, 21Ba, 22Aa, and 22Ba secured to the housing 10. Therefore, the spring length is long, so that it is possible to obtain a sufficient amount of displacement when the first, second, third, and fourth bends 21Ad, 21Bd, 22Ad, and 22Bd are elastically deformed. This makes it possible to produce first-row contacts 21 and second-row contacts 22 that can withstand numerous repetitious connections to a circuit board PCB.

Furthermore, the first, second, third, and fourth pad interfaces 21Ae, 21Be, 22Ae, and 22Be respectively extend toward the opposite sides of the first, second, third, and fourth bends 21Ad, 21Bd, 22Ad, and 22Bd beyond the extension lines L of the first, second, third, and fourth centerpieces 21Aa, 21Ba, 22Aa, and 22Ba. As a result, when the first, second, third, and fourth pad interfaces 21Ae, 21Be, 22Ae, and 22Be elastically contact the conductive pads PA and PB on the circuit board PCB, it is possible to ensure wiping of the first, second, third, and fourth pad interfaces 21Ae, 21Be, 22Ae, and 22Be,—that is, in the case of the elastic contact parts Ae, for example, sliding to the leftward direction away from the extension line L.

Moreover, because the thickness of the first, second, third, and fourth bends 21Ad, 21Bd, 22Ad, and 22Bd is made to be smaller than the thickness of the first, second, third, and fourth centerpieces 21Aa, 21Ba, 22Aa, and 22Ba, the internal stress distribution of the first, second, third, and fourth bends 21Ad, 21Bd, 22Ad, and 22Bd can be controlled, making it possible to avoid the concentration of the stress in the first, second, third, and fourth centerpieces 21Aa, 21Ba, 22Aa, and 22Ba that serve as the fixed ends of the first, second, third, and fourth bends 21Ad, 21Bd, 22Ad, and 22Bd, compared to a case in which the thickness of the first, second, third, and fourth bends 21Ad, 21Bd, 22Ad, and 22Bd is set to be constant and the same as that of the first, second, third, and fourth centerpieces 21Aa, 21Ba, 22Aa, and 22Ba. Consequently, first-row contacts 21 and second-row contacts 22 can be obtained which can withstand numerous repeated connections to the circuit board PCB.

One embodiment of the present invention has been described above. However, the present invention is not limited to this embodiment; various alterations or modifications can be made.

For example, it is sufficient if contacts are provided in one or more rows; it is not necessarily needed to provide contacts in two rows.

Furthermore, it is not necessarily needed to form the first, second, third, and fourth bends 21Ad, 21Bd, 22Ad, and 22Bd with a thickness that is smaller than the thickness of the first, second, third, and fourth centerpieces 21Aa, 21Ba, 22Aa, and 22Ba; the thickness of these elastic contact parts may also be the same as that of the first, second, third, and fourth centerpieces 21Aa, 21Ba, 22Aa, and 22Ba.

What is claimed is:

1. A board mount-type connector, comprising:

an insulative housing having a base;

a row of contacts carried by the housing, each contact comprising a centerpiece secured to the housing along a substantially vertically upright inner wall of the base, a mating interface connected to one end of the centerpiece so that the mating interface contacts a mating contact, a board interface connected to the remaining end of the centerpiece so that the board interface connects to a circuit board;

wherein the each board interface comprises a bend that initially extends away from an extension line associated with a generally vertically upright portion of the respective centerpiece and that is bent back toward the extension line;

wherein a pad interface extends from the free end of the board interface toward the extension line; and wherein the contacts of the row are staggered along a length of the row.

2. The board mount-type connector according to claim 1, wherein each of the pad interfaces extends beyond the extension line.

3. The board mount-type connector according to claim 2, wherein each of the pad interfaces are fully located beyond the extension line opposite the remainder of board interface.

4. The board mount-type connector according to claim 1, wherein a thickness of the bend is less than a thickness of the respective centerpiece.

5. The board mount-type connector according to claim 1, wherein the contacts are arranged in at least two rows.

6. The board mount-type connector according to claim 5, wherein the at least two rows are substantially parallel.

7. The board mount-type connector according to claim 5, wherein the at least two rows are at least partially separated by a mating recess.

8. The board mount-type connector according to claim 5, wherein each of the mating interfaces extends inward toward an opposing row.

9. The board mount-type connector according to claim 5, wherein each of the mating interfaces extends inward toward an opposing row by a substantially equal distance.

10. The board mount-type connector according to claim 5, wherein opposing contacts of opposing rows are at least partially separated by a partition wall.

11. The board mount-type connector according to claim 5, wherein the bend of the board interface is located within a bend groove of a partition wall.

12. The board mount-type connector according to claim 1, wherein the bends of adjacent contacts of the same row initially extend in opposing directions away from the extension line.

13. The board mount-type connector according to claim 1, wherein the mating interfaces of adjacent contacts of the same row are bent inward at different vertical heights.

14. The board mount-type connector according to claim 1, wherein a free end of the mating interface is retained by a mating wall.

15. A board mount-type connector assembly, comprising:

a board mount-type connector, comprising:

an insulative housing having a base; and a row of contacts carried by the housing, each contact comprising a centerpiece secured to the housing along a substantially vertically upright inner wall of the base, a mating interface connected to one end of the centerpiece so that the mating interface contacts a mating contact, a board interface connected to the remaining end of the centerpiece so that the board interface connects to a circuit board;

wherein the each board interface comprises a bend that initially extends away from an extension line associated with a generally vertically upright portion of the respective centerpiece and that is bent back toward the extension line;

wherein a pad interface extends from the free end of the board interface toward the extension line; and wherein the contacts of the row are staggered along a length of the row; and a frame configured to receive and retain the board mount-type connector.

16. The board mount-type connector assembly according to claim 15, the frame comprising:

a connector accommodating hole to receive the board mount-type connector.

17. The board mount-type connector assembly according to claim 16, the frame further comprising:

a stopper protruding into the connector accommodating hole, the stopper being configured to obstruct movement of the board mount-type connector.

18. The board mount-type connector assembly according to claim 17, wherein the stopper is configured to contact the base of the housing.

19. The board mount-type connector assembly according to claim 18, further comprising a printed circuit board configured to contact the frame and the board mount-type connector, thereby retaining the board mount-type connector within the connector accommodating hole.

20. The board mount-type connector assembly according to claim 19, the printed circuit board comprising a conductive pad that contacts one of the pad interfaces.

* * * * *